US006358139B1

(12) United States Patent
Renz

(10) Patent No.: US 6,358,139 B1
(45) Date of Patent: Mar. 19, 2002

(54) SUPER-CLEAN AIR DEVICE FOR THE PHARMACEUTICAL, FOODSTUFF, AND BIOTECHNOLOGY SECTOR

(75) Inventor: Manfred Renz, Ditzingen (DE)

(73) Assignee: M+W Zander Facility Engineering GmbH, Stuttgart (DE)

( * ) Notice: Subject to any disclaimer, the term of this patent is extended or adjusted under 35 U.S.C. 154(b) by 0 days.

(21) Appl. No.: 09/663,471

(22) Filed: Sep. 15, 2000

(30) Foreign Application Priority Data

Sep. 16, 1999 (DE) ..... 299 16 321

(51) Int. Cl.[7] ..... B01L 1/04

(52) U.S. Cl. ..... 454/187; 454/236; 55/385.2; 55/467.1

(58) Field of Search ..... 454/187, 233, 454/234, 236; 55/385.2, 467.1, 470, 471, 473

(56) References Cited

U.S. PATENT DOCUMENTS 3,728,866 A * 4/1973 Layton ..... 454/187
4,164,901 A * 8/1979 Everett ..... 454/228
4,202,676 A * 5/1980 Pelosi, Jr. et al. ..... 96/416
4,549,472 A * 10/1985 Endo et al. ..... 454/187
4,560,395 A * 12/1985 Davis ..... 454/187
4,699,640 A * 10/1987 Suzuki et al. ..... 454/233
5,876,279 A * 3/1999 Renz et al. ..... 454/187
5,876,489 A * 3/1999 Kunisaki et al. ..... 55/385.2

* cited by examiner

*Primary Examiner*—Jiping Lu
(74) *Attorney, Agent, or Firm*—Gudrun E. Huckett

(57) ABSTRACT

A super-clean air device for the pharmaceutical sector, foodstuff sector, and biotechnology sector has at least one fan for conveying fresh air in a conveying direction into the clean room and for removing return air from the clean room. At least one filter is arranged downstream of the fan in the conveying direction. At least one heat exchanger is arranged upstream of the fan in the conveying direction. A common housing is provided and is designed to form a mounting module, wherein the at least one fan, the at least one filter, and the at least one heat exchanger are arranged in the common housing for ease of installation.

25 Claims, 8 Drawing Sheets

SUPER-CLEAN AIR DEVICE FOR THE PHARMACEUTICAL, FOODSTUFF, AND BIOTECHNOLOGY SECTOR

BACKGROUND OF THE INVENTION

1. Field of the Invention

The invention relates to a super-clean air device for the pharmaceutical industry, foodstuff industry, and biotechnology sector, comprising at least one fan having arranged downstream thereof at least one filter and arranged upstream thereof at least one heat exchanger, preferably a cooling unit.

2. Description of the Related Art

It is known in the pharmaceutical industry, food industry, and in the biotechnology sector to treat products, aside form clean rooms of class A, also in clean rooms of classes B, C, and D. In these clean rooms the super-clean air is supplied via fans which are arranged in the ceiling of the corresponding clean room. The clean air is supplied via channels by circulating air devices which are connected to at least one external air device which is located in the area outside of the clean room. These super-clean air devices have a complicated configuration because of the channel system for supplying the fresh air and they require a correspondingly large mounting space.

SUMMARY OF THE INVENTION

It is an object of the present invention to configure a super-clean air device such that the fresh air can be supplied in a constructively simple way reliably to the respective clean room while the device has compact dimensions.

In accordance with the present invention, this is achieved in that the fan, the filter, and the heat exchanger are mounted in a common housing which is formed as a mounting module.

In the super-clean air device according to the invention the fan, the filter, and the heat exchanger are mounted in a common housing. With this configuration complicated channels for the supply of fresh air or for the return of return air are no longer required. The fresh air flowing through the filter reaches directly the clean room while the return air is supplied directly from the clean room to the heat exchanger. The super-clean air device according to the invention is thus of a constructively simple configuration and can be mounted without great expenditure. Due to the configuration according to the invention, the super-clean air device in the form of a modular unit has only small dimensions so that the super-clean air device can also be mounted in situations where the available mounting space is minimal.

DESCRIPTION OF THE PREFERRED EMBODIMENTS

Figure 1:
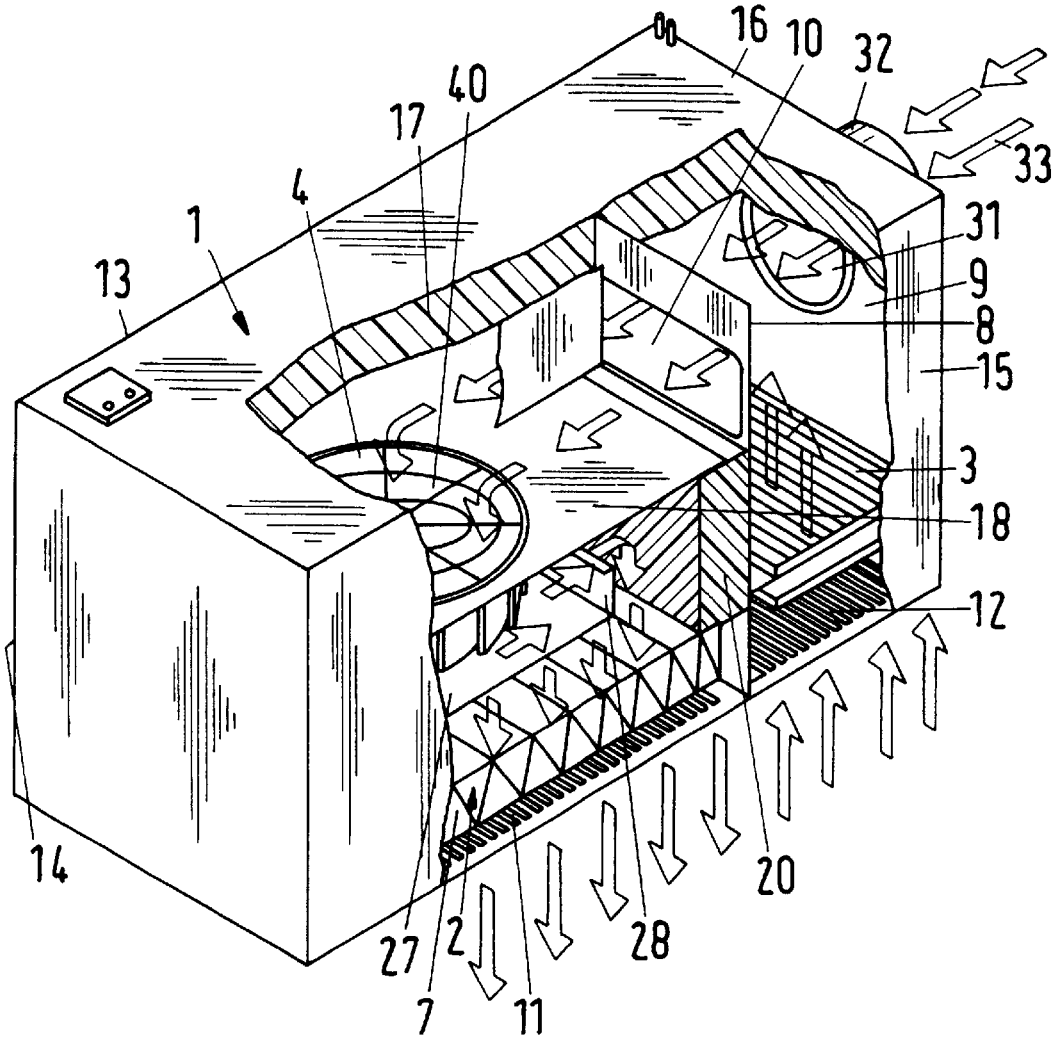
FIG. 1 is a perspective illustration of a super-clean air device according to the invention.

The super-clean air device is provided for use in the pharmaceutical or food industry or also in the area of biotechnology. The super-clean air device is formed as a module and can be used in clean room areas of the classes B, C, and D. The super-clean air device according to FIGS. 1 through 3 has a housing 1 in which adjacent to one another a filter fan unit 2 and the heat exchanger 3 are arranged. The heat exchanger 3 in the embodiments described in the following is advantageously embodied as a cooling device. The filter fan unit 2 has a fan 4 which takes in super-clean air from an intake chamber 5 which is positioned in the area between the fan 4 and a cover 6 of the housing 1. A filter 7 is provided below the fan 4. This filter 7 is configured as known to a person skilled in the art. Clean air flows through the filter 7 into the clean room.

The filter fan unit 2 is separated by a partition 8 from the chamber 9 in which the cooling unit (cooler) 3 is received. The partition 8 is provided with an opening 10 which connects the receiving chamber 9 with the fresh air chamber 5.

The filter 7 is positioned with minimal spacing above a fresh air grating 11 through which the fresh air enters the clean room. The cooler 3 is provided in the area above a return air grating 12 through which the return air flows to the cooling unit 3.

The housing 1 in the shown embodiment is of a parallelepipedal shape. However, any other suitable shape can be, of course, selected. Advantageously, the cover 6 and the sidewalls 13 through 16 adjoining it are made of metal. On the inner side of the cover 6 a sound proofing layer 17 is positioned.

The fan 4 is secured on a plate 18 which has, for example, a square contour (FIG. 2) and projects at least at two opposite sides past a sound proofing layer 19, 20 and is connected to the housing sidewall 14 and the partition 8. The sound proofing layer 19 is provided on the inner side of the housing wall 14 and the opposite sound proofing layer 20 on the partition 8. This partition 8 extends from the housing bottom to the housing cover 6 between the oppositely positioned housing walls 13, 15. The partition 8 is also advantageously comprised of metal.

Figure 3:
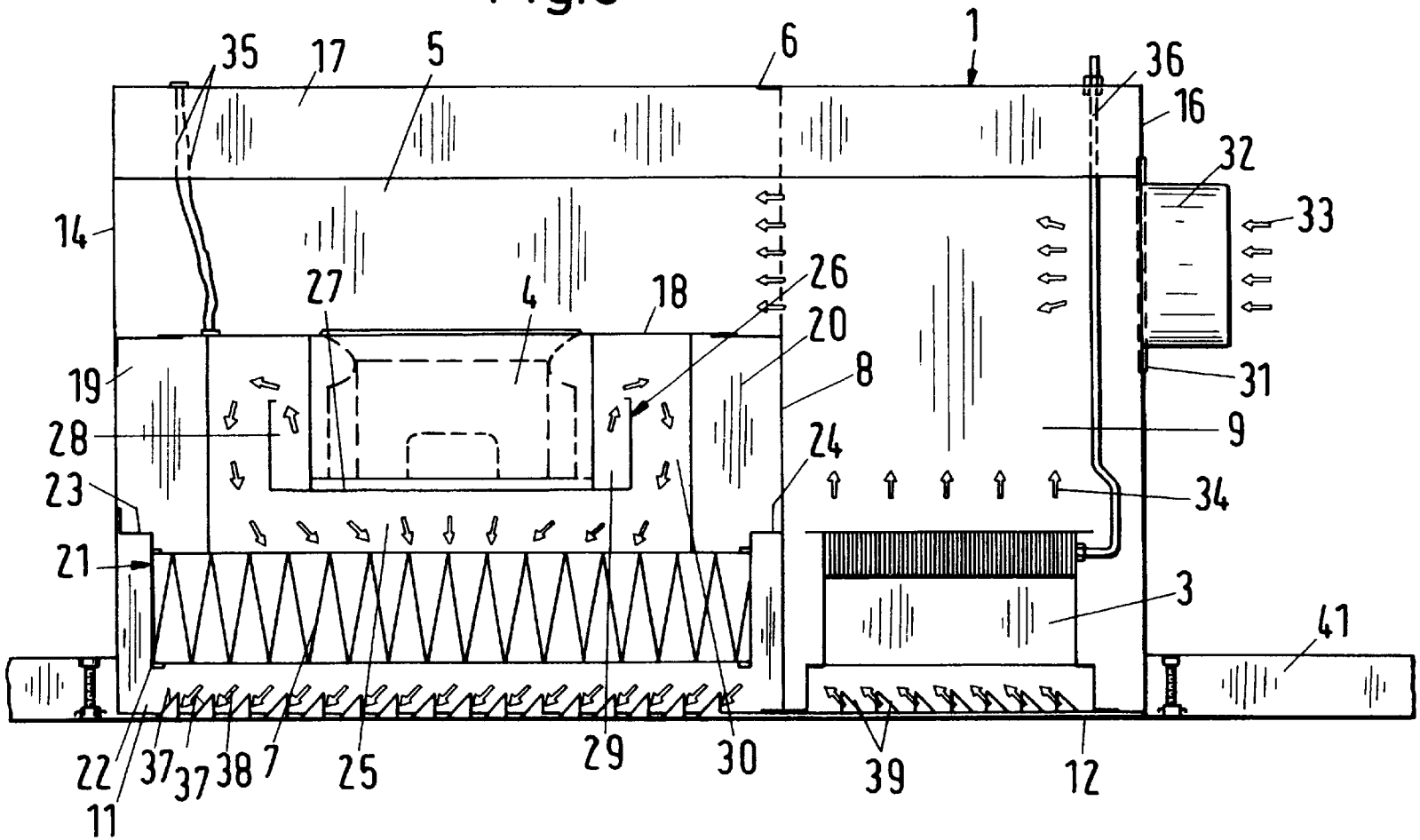
FIG. 3 is a section view along the line 111—111 in FIG. 2.

As illustrated in FIG. 3, the filter 7 is received in a frame 21 whose frame sides have a substantially L-shaped cross-section. The filter 7 rests on the leg 22 which is the lower leg of the frame 21 in the mounted position. Parallel to the inwardly angled frame leg 22, the frame 21 has an upper frame leg 23 whose free end 24 is angled upwardly and with which the frame 21 is fastened to the inner side of the housing sidewalls 13 through 15 and the partition 8, respectively.

The fan 7 is positioned at a spacing below the fan 4 so that a flow space 25 is formed between the aid and the filter. The flow space 25 ensures that the clean air can be uniformly supplied across the entire surface of the filter 7.

At the underside of the fan 4 a deflection device 26 is fastened. It is formed by a planar plate 27 which projects on all sides past the fan 4 and has an outer edge 28 extending upwardly at a right angle. The clean air which is taken in by the fan 4 flows into the annular space 29 formed between the plate edge 28 and the fan 4 in a way which will be described in the following. In this space 29 the clean air flows upwardly. Since the plate edge 28 ends at a spacing below the support plate 18, the clean air can exit the annular chamber 29 and can enter the flow space 30 between the plate edge 28 and the sound proofing layers 19, 20. The flow space 30 has a transition into a flow space 25, and the clean air flows through the flow space 30 into the flow space 25. From the flow space 25 the clean air flows through the filter 7 and reaches via the fresh air grating 11 the clean room positioned underneath.

The sound proofing layer 17 extends over the entire inner side of the housing cover 6 so that it is also provided in the cooler receiving chamber 9 (FIG. 3). An opening 31 is provided In the housing sidewall 16. An intake opening or socket 32 is connected at the exterior side to the sidewall 16 and the external air 33 can be supplied via this socket 32. The intake opening 31 is positioned immediately adjoining the sound proofing layer 17 on the cover 6 and is thus positioned at a spacing above the cooling unit 3. The exterior air 33 flows at a right angle relative to the return air 34 into the housing chamber 9 in which the external air 33 is mixed with the return air 34. The housing chamber 9 thus also forms a mixing chamber for the external air and the return air. The mixed air then flows from the chamber 9 through the opening 10 of the partition 8 into the fresh air chamber 5 between the support plate 18 and the sound proofing layer 17 on the cover 6.

Electrical supply lines 35 for the fan 4 as well as lines 36 for the cooling unit 3 are guided through the housing cover 6 and the sound proofing layer 17.

The partition 8 divides the housing 1 into two housing chambers or receiving chambers, wherein the receiving chamber of the fan is greater than the housing chamber 9 of the cooling unit.

The fresh air grating 11 has fresh air outlet openings distributed across its surface. Guide plates 37 adjoin the outlet openings 11. They are slantedly positioned and parallel to one another. They extend from the opening edge at a slant in the direction toward the receiving chamber 9 for the cooler 3. Accordingly, the fresh air 38 first flows at a slant into the clean room underneath. Because of the guide plates 37 the fresh air 38 flows at a slant away from the chamber 9 so that this fresh air does not directly flow via the return air grating 12 to the cooling unit 3.

The return air grating 12 is also provided across its surface with return air inlet openings having connected thereto guide plates 39. They are also positioned parallel to one another and are slanted in a direction oppositely to that of the guide plates 37 of the fresh air grating 11.

When the clean air device is in operation, the filtered fresh air 38 flows through the fresh air grating 11 directly into the clean room. Subsequently, the return air 34 now containing particles flows through the return grating 12 to the cooling unit 3 and passes through it. In doing so, the return air 34 is cooled. The cooling device 3 is positioned horizontally approximately at the level of the filter 7. The return air 34 flows within the cooler receiving chamber 9 in the upward direction and reaches through the opening 10 in the partition 8 the fresh air chamber 5 above the fan 4. Optionally, via the intake socket 32 external air 33 can be supplied to the cooler receiving chamber 9 in which the external air 33 is mixed with the cooled return air 34. In this case, this air mixture flows though the opening 10 into the air chamber 5. In the fresh air chamber 5 the return air flows through an opening 40 (FIG. 1) provided in the support plate 18 into the fan 4. The support plate 18 closes off the annular chamber 29 as well as the flow space 30 in the upward direction relative to the fresh air chamber 5. The air exiting from the fan 4 reaches the annular chamber 29 by being deflected in the upper direction by the upwardly extending plate edge 28. The fresh air then flows via the flow space 30 that surrounds the annular space 29 in the downward direction into the flow chamber 25 which ensures that the fresh air is uniformly distributed across the intake surface of the filter 7. While the fresh air 28 flows through the filter 7, the fresh air 38 is cleaned and filtered, as is known in the art, before reentering the clean room.

Instead of the annular chamber 29 it is also possible to provide on both sides of the fan 4 parallel extending flow channels which extend between the housing sidewalls 13 and 15. In this case, the air coming from the fan 4 flows via the plate edges 28 into the flow channels.

Figure 2:
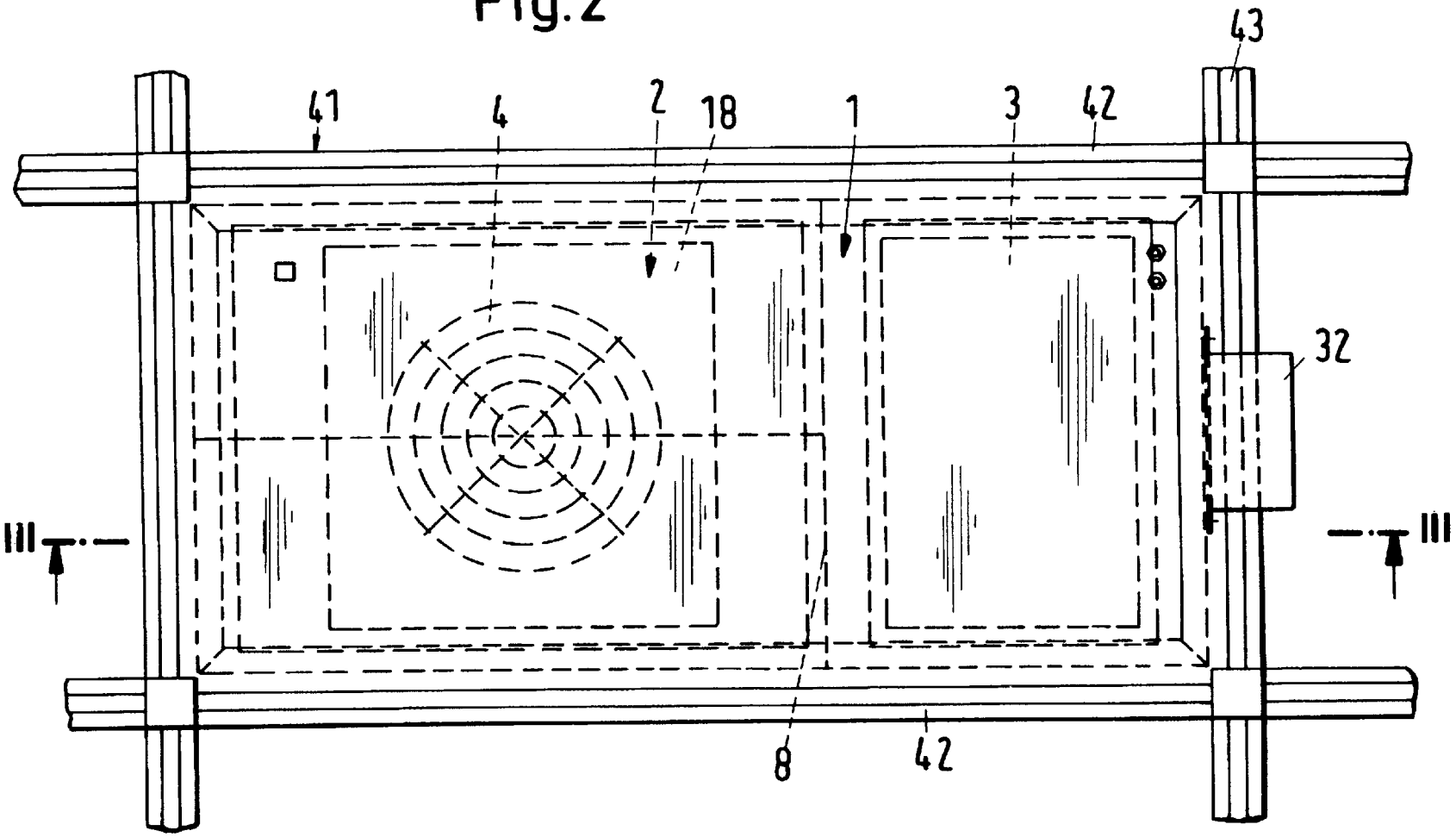
FIG. 2 shows the super-clean air device according to FIG. 1 in a plan view.

Since in the super-clean air device the fan 4, the filter 7 and the cooling unit 3 are mounted in a common housing, a complicated channel system for guiding the return air is not required. The clean-air device is formed as a mounting module which can be inserted, for example, into an opening of a modular ceiling 41. In FIGS. 2 and 3 support rails 42 and 43 of the modular ceiling 41 are illustrated which cross one another at a right angle. However, is also possible to suspend the modules from the ceiling of the building and to provide at the side of the clean room a suspended ceiling, for example comprised of modular sheet metal.

Figure 4:
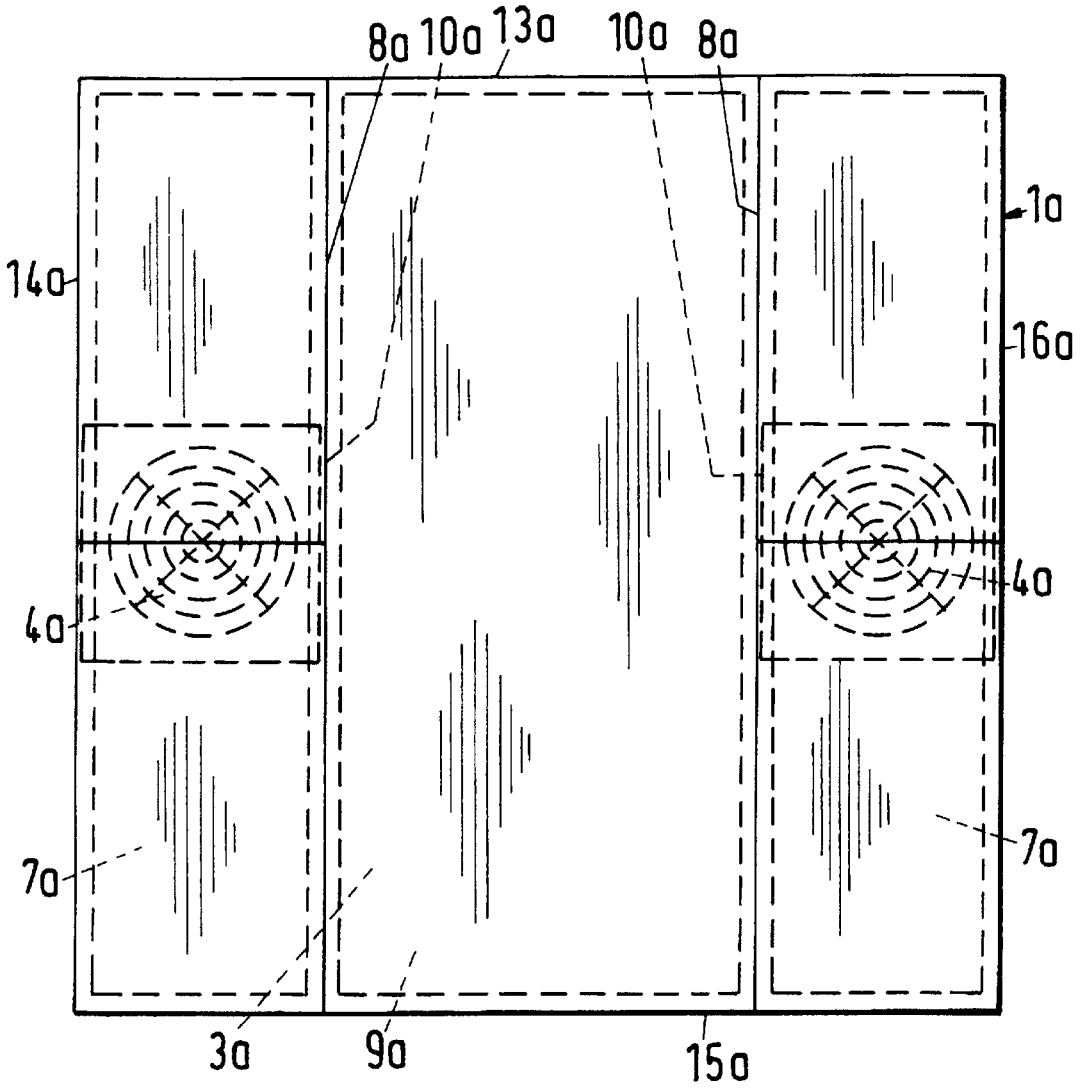
FIG. 4 shows a plan view onto a second embodiment of the super-clean-air device according to the invention.

In the embodiment according to FIG. 4, the module has a symmetric configuration. The housing 1*a* has a square contour. A fan 4*a* each is arranged within the housing 1*a* on two oppositely positioned housing sides 14*a*, 16*a*. The two fans 4*a* are positioned at half the length of the housing sidewalls 14*a,* 16*a* at the same level. They are of the same configuration as the fan 4 according to FIGS. 1 through 3.

Below the two fans 4*a* a filter 7*a* with a rectangular contour is provided respectively. In accordance with the previous embodiment, the filters 7*a* extend between the oppositely positioned housing sidewalls 13*a,* 15*a*. Moreover, the filters 7*a* extend between the housing sidewalls 14*a,* 16*a* and the partitions 8*a* extending parallel thereto. These partitions 8*a* extend also parallel to the housing sidewalls 14*a,* 16*a* between the housing sidewalls 13*a,* 15*a*. The partitions 8*a* separate in the area above the fans 4*a* the fresh air chambers from the cooler receiving chamber 9*a* in which the cooler 3*a* is positioned. The cooler 3*a* is also horizontally arranged in its mounted position and extends in accordance with the previous embodiment between the oppositely positioned parallel extending housing sidewalls 13*a,* 15*a*. Moreover, the cooler 3*a* extends between the parallel extending partitions 8*a*. Below the cooler 3*a* the return air grating is positioned via which the return air flows from the clean room into the cooler chamber 9*a*. When passing through the cooler 3*a,* the return air is cooled and flows then through the openings 10*a* provided in the partitions 8*a* into the fresh air chambers in the area above the fans 4*a* . The return air taken in by the fans 4*a* can be deflected and guided in the same way as described in connection with FIGS. 1 through 3. Otherwise, this embodiment is identically constructed as the embodiment according to FIGS. 1 through 3.

Figure 5:
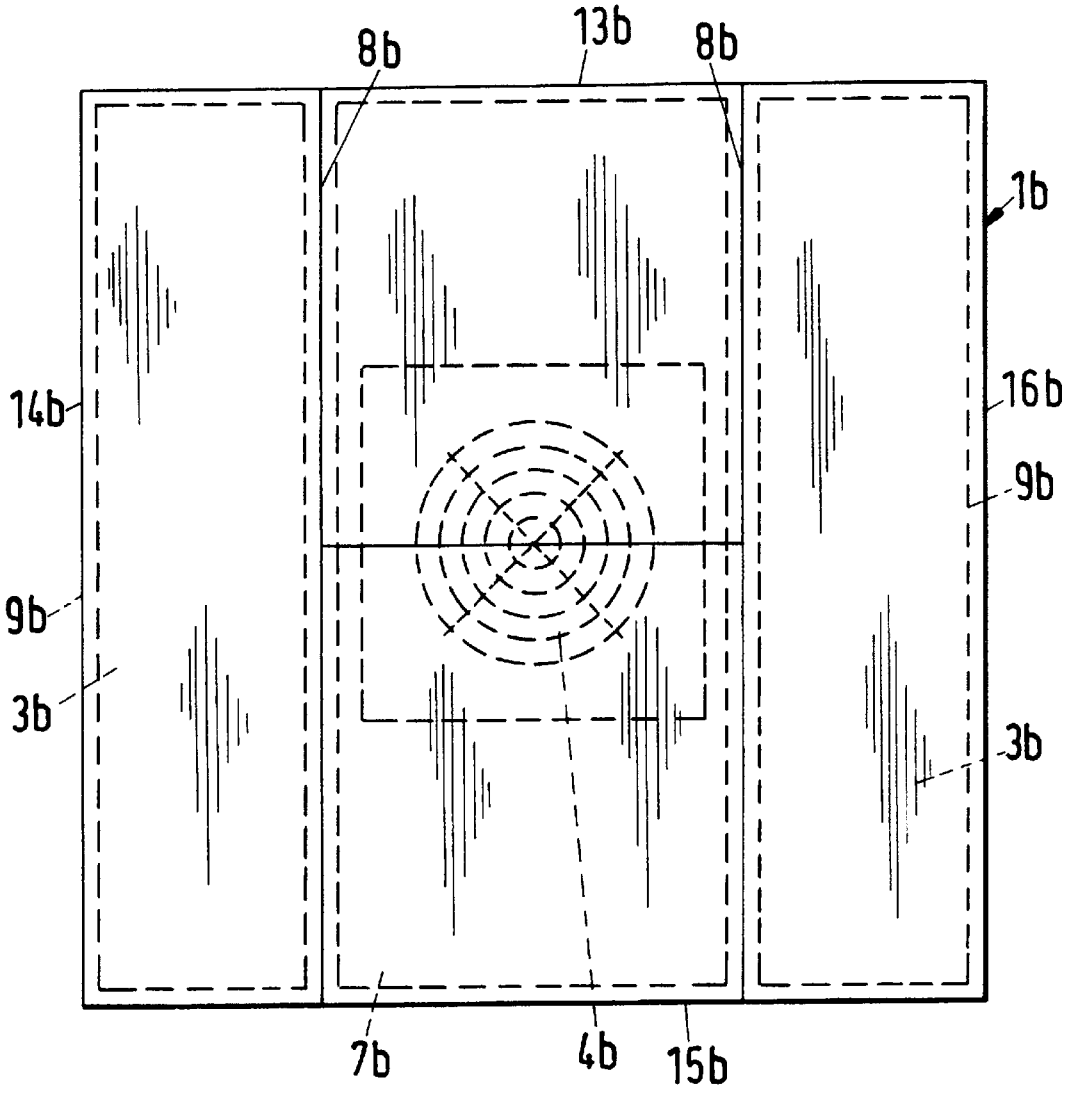
FIG. 5 is a plan view onto a third embodiment of the super-clean-air device according to the invention

FIG. 5 shows an embodiment in which the housing 1*b* is divided by partitions 8*b* in the same way as in the embodiment of FIG. 4*a*. In contrast to the previous embodiment, only a single fan 4*b* is provided which is positioned in the middle housing chamber of the housing 1*b,* while in both adjacent housing chambers a cooler 3*b* is arranged, respectively. The two coolers 3*b* are advantageously of identical configuration and extend between the opposite housing sidewalls 13*b,* 15*b* as well as between the housing sidewalls 14*b,* 16*b* and the partitions 8*b* extending parallel thereto. The fan 4*b* is arranged centrally in the housing 1*b.*

The return air taken in by the fan 4*b* flows from the cooler chamber 9*b* through corresponding openings in the partitions 8*b* into the central fresh air chamber which is positioned in the area above the fan 4*b.* In the area below the fan 4*b* the filter 7*b* extends between the oppositely positioned housing sidewalls 13*b,* 15*b* as well as between the parallel extending partitions 8*b* connected at a right angle to the sidewalls 13*b,* 15*b.* In other respects, this embodiment is identical to the embodiment according to FIGS. 1 through 3. One of the housing sidewalls can be provided with a fresh air socket in order to supply external air to the cooler chamber 9*b.* A corresponding fresh air socket can also be provided in the embodiment according to FIG. 4.

Figure 6:
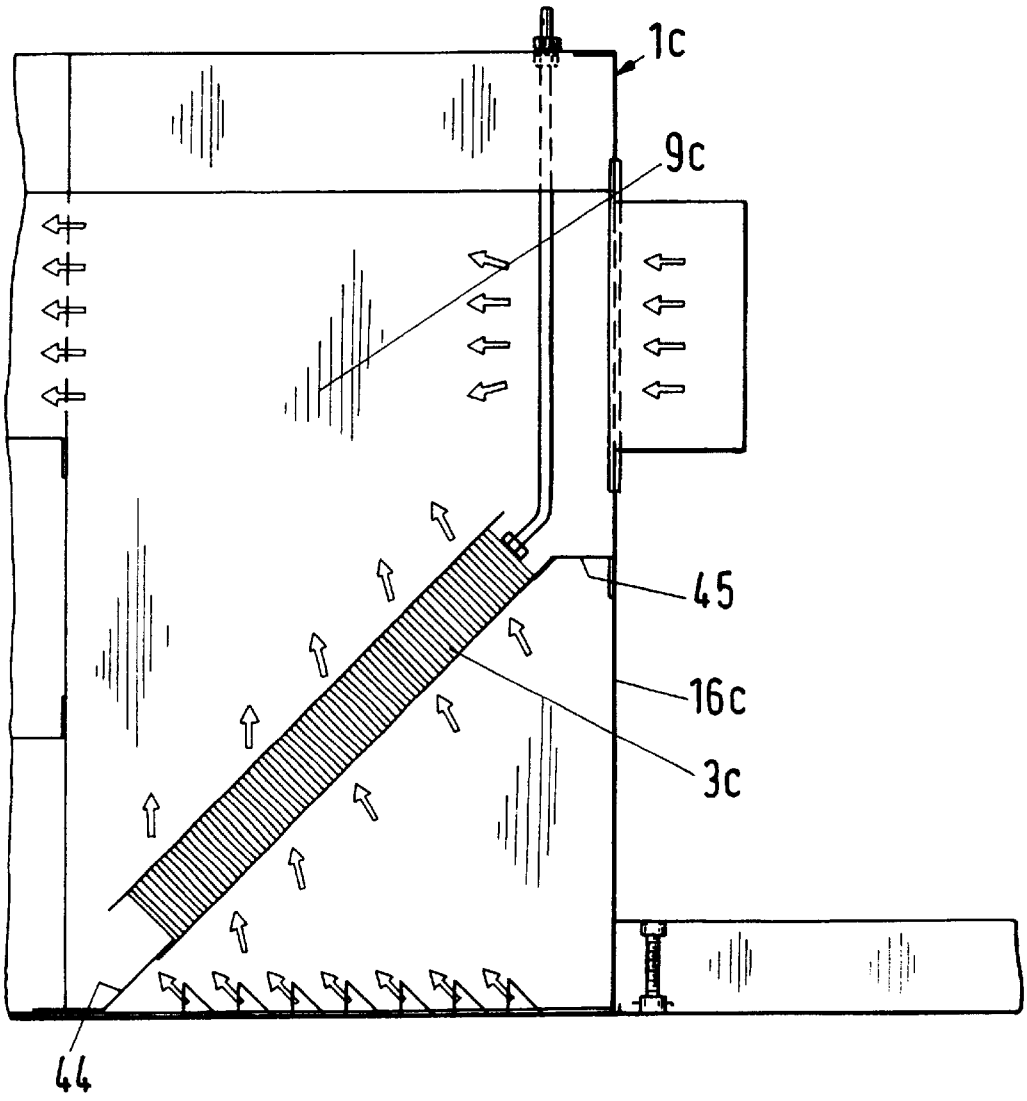
FIG. 6 is a section view of a further embodiment of a heat exchanger of the super-clean-air device according to the invention.

FIG. 6 shows the possibility of arranging the cooler 3*c* not horizontally but at a slant within the cooler chamber 9. This slanted position has the advantage that the cooler chamber 9*c* can be configured very narrow so that the corresponding housing 1*c* has small outer dimensions. The cooling effect is not affected by the slanted position of the cooler 3*c.*

The slantedly arranged cooler 3*c* is fastened in securing rails 44, 45 on the housing bottom as well as on the housing sidewall 16*c.* Such a slantedly arranged cooler can also be provided in all of the above described embodiments so that the corresponding modules have small dimensions.

In a further embodiment (not illustrated) the fan is arranged in the area above the cooler. The return air flows in this case through the return air grating and through the cooler before it reaches the fan positioned above. From here the air is guided into the filters which extend in the area adjacent to the cooler above the fresh air grating. The cooler is advantageously centrally arranged and separated by partitions relative to the filters so that the return air must flow in any case through the cooler and through the fan before it reaches the filters.

Figure 7:
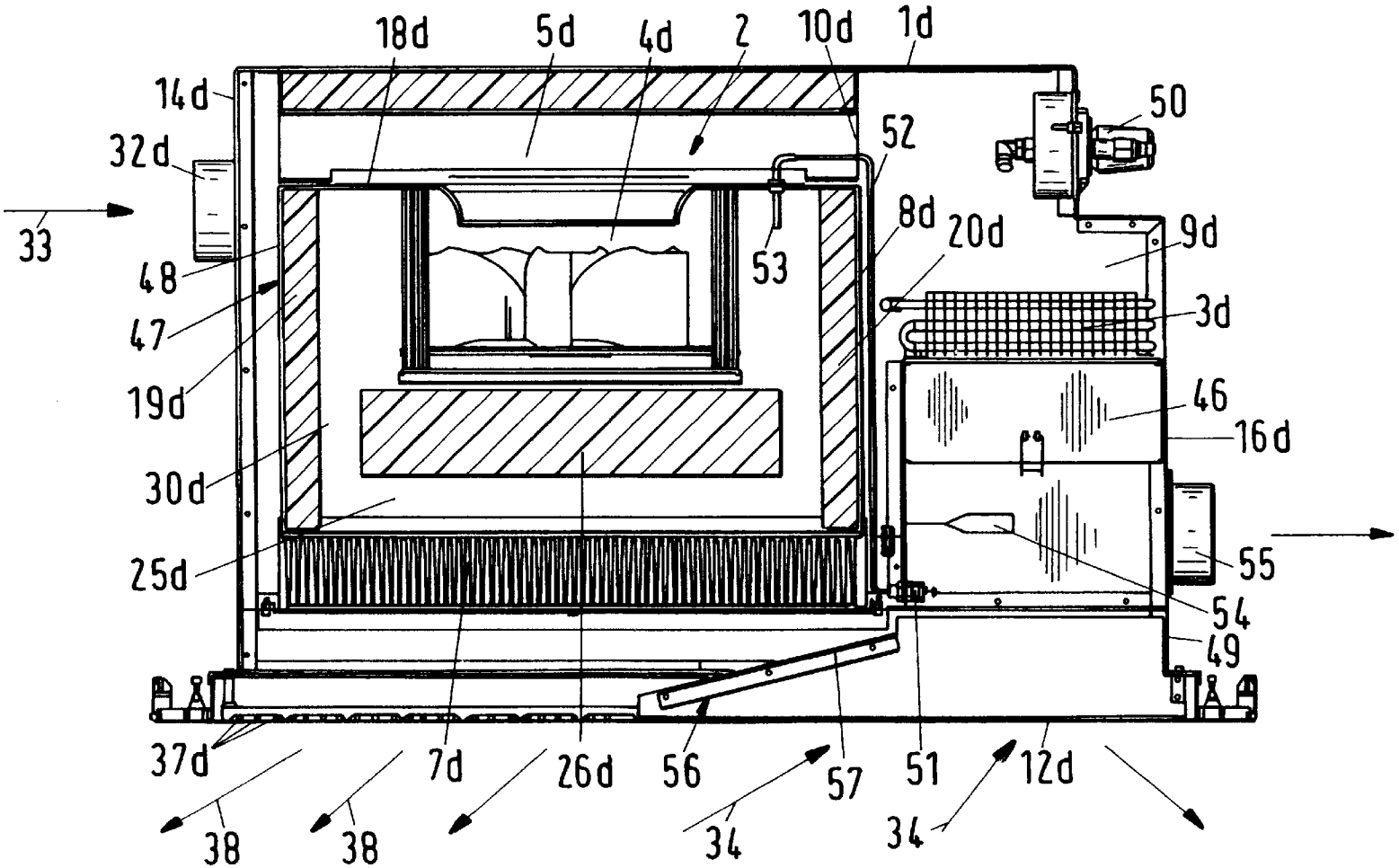
FIG. 7 is a representation corresponding to FIG. 4 of a further embodiment of the super-clean air device according to the invention.
Figure 8:
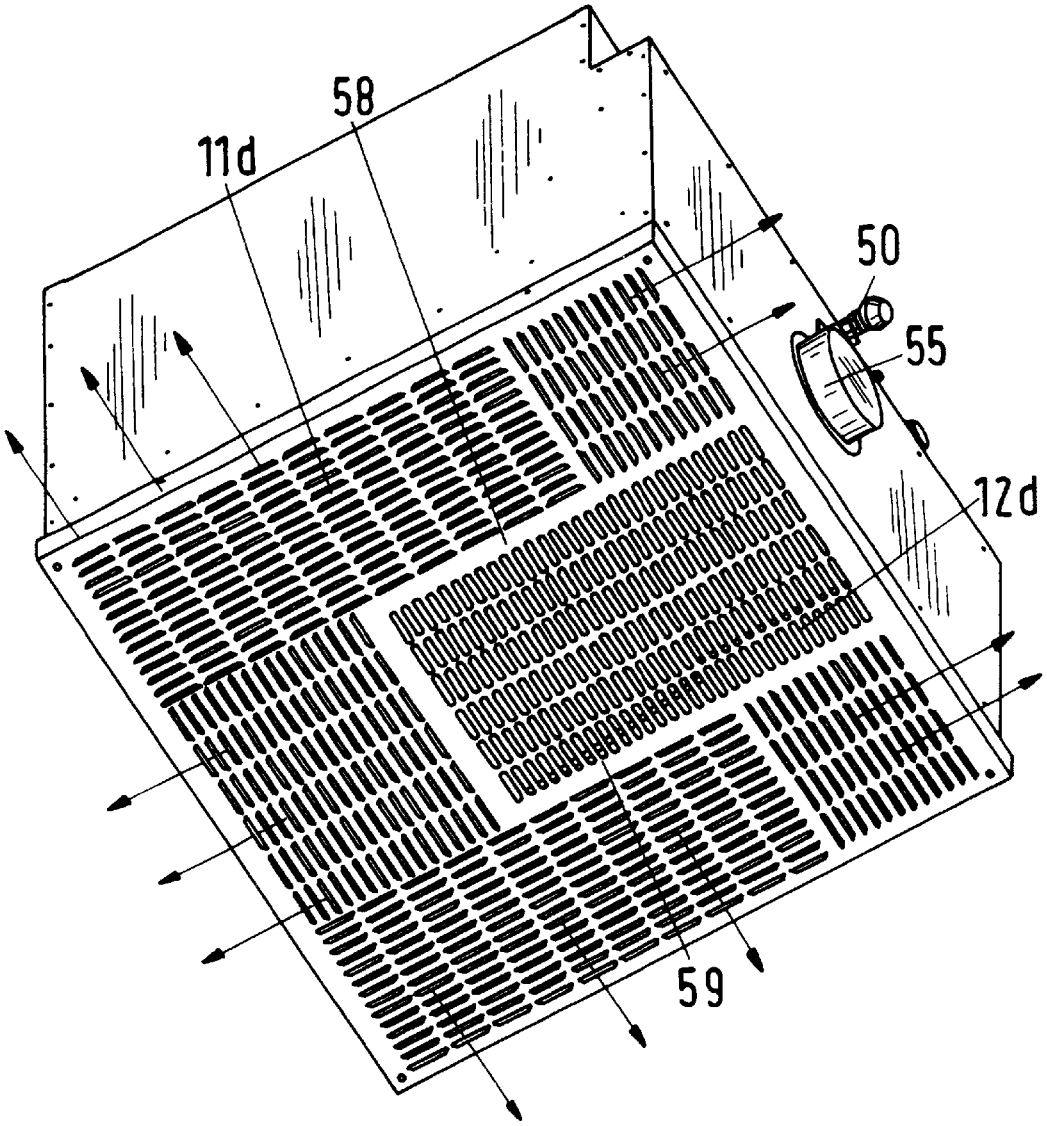
FIG. 8 shows the super-clean-air device according to FIG. 7 in a view at an angle from below.

In the embodiment according to FIGS. 7 and 8 in the chamber 9*d* the cooler 3*d* is arranged which has arranged upstream thereof a pre-filter 46. It is positioned in a flow channel 64 for the return air 34. The filter fan unit 2 is inserted into the housing 1*d* adjacent to the cooler 3*d* and comprises a fan 4*d* which is suspended from the plate 18*d.* According to the embodiment of the FIGS. 1 and 3, the sound proofing layers 19*d,* 20*d* are provided which extend from the filter 7*d* to the level of the plate 18*d.*

At a minimal spacing below the fan 4*d* the deflection device 26*d* is provided which is advantageously also comprised of sound proofing material. The air which is taken in from the fresh air chamber 5*d* exits downwardly from the fan 4*d* and is laterally deflected at the deflecting device 26*d.* Accordingly, the air flows first into the flow space 30*d* and subsequently into the flow space 25*d.* The flow space 30*d* is an annular chamber and is positioned in the area between the fan 4*d* or the deflecting device 26*d* and the sound proofing layers 19*d,* 20*d.* The flow space 25*d* is delimited in the upward direction by the deflecting device 26*d.* From here, the air flows through the filter 7*d* in the downward direction to the outlet, which will be described in the following, via which the super-clean air reaches the clean room positioned below.

The fan 4*d,* the sound proofing layer 19*d,* 20*d* the deflecting device 26*d,* and the filter 7*d* form a modular unit 47 which can be inserted into the housing 1*d* of the super-clean air device. The unit 47 has a housing 48 on whose sidewalls the sound proofing layers 19*d,* 20*d* are positioned. The housing 48 is closed off in the downward direction by the filter 7*d.* In the upward direction the housing 48 is closed off by inwardly directed portions of the sidewall, bent at a right angle, as well as by the plate 18*d* fastened thereto. The unit 47 can be pre-mounted and can be simply inserted into the housing 1*d* of the super clean air device.

The housing 1*d* of the super clean air device is seated on a mounting frame 49 with which the device, as has been explained in connection with the embodiment according to FIGS. 1 through 3, can be placed onto the modular ceiling 41 or can be suspended from the ceiling of the building.

The fresh air socket 32*d* is provided in the sidewall 14*d* of the housing 1*d.* Accordingly, the fresh air socket 32*d* is positioned on the side of the filter-fan unit 2 facing away from the cooler 3*d.* This arrangement has the advantage that the air which flows through the cooler 3*d* and enters the fresh air chamber 5*d* as well as the external air supplied via the fresh air socket 32 is taken in symmetrically by the fan 4*d* from the fresh air chamber 5*d.*

As has been explained in connection with FIGS. 1 through 3, the return air 34 flows via the cooler 3*d* into the chamber 9*d* and reaches via the opening 10*d* the fresh air chamber 5*d.* The air exiting from the fan 4*d* is deflected at the deflecting device 26*d* radially outwardly and flows via the flow space 30*d* into the flow space 25*d* and from there through the filter 7*d.* The flow space 25*d* makes it possible that the fresh air is uniformly distributed across the intake surface of the filter 7*d.* When passing through the filter 7*d,* the fresh air is cleaned and filtered, as is known in the prior art, before entering the clean room.

At the upper edge of the sidewall 16*d* of the housing 1*d* a thermostat-operated control valve 50 is provided with which the cooler 3*d* can be controlled.

Below the pre-filter 46 in the chamber 9*d* a measuring socket 51 is provided to which a further measuring socket 53 is connected via the measuring line 52. The socket 53 is positioned in the area adjacent to the fan 4*d* in the flow space 30*d.* Via this measuring socket 53 a measuring sensor connected with the measuring socket 51 can measure the pressure in the flow chamber 30*d.* Moreover, the pressure below the filter 7*d* can be measured with a further sensor (not shown). Based on the pressure difference the load situation of the filter 7*d* can be determined. For example, it can be determined when the filter 7*d* has to be cleaned and/or exchanged. With the two measuring sockets 51 and 53 it is also possible to measure the particle concentration in the flow path of the air upstream of the filter 7*d.* Especially when using the super-clean air device in the pharmaceutical sector, the integrity of the high efficiency submicron particulate air filter 7*d* can be monitor and checked.

In the area below the pre-filter 46 in the flow channel 68 a temperature sensor 54 is provided which acts on the thermostat-operated control valve 50. Instead of the thermostat-operated control valve it is also possible to employ an electric or electro-motoric control valve. In addition, in the flow channel 60 a further temperature sensor can be installed with which the room temperature can be measured.

The wall 16*d* of the housing 1*d* is provided with a socket 55 via which, if needed, the entire or portions of the return air can be supplied to a downstream escape air device (not shown).

The filtered and cooled fresh air 38 enters on all sides and with turbulence the clean room. It is distributed in the clean room and is removed via the return air grating 12*d* from the clean room to be again cooled via the heat exchanger 3*d.*

As is shown in FIG. 8, the return air grating 12*d* is surrounded on three sides by the fresh air grating 11*d*. The fresh air grating 11*d* has a U-shape and is provided with guide plates via which the outflowing super-clean air can be blown into the clean room. The guide plates 37*d* in the individual areas of the fresh air grating 11*d* are positioned such that the super-clean air can flow in different directions. In FIG. 8 the outflow directions of the super-clean air are illustrated by arrows. The guide plates are correspondingly positioned at a slant so that the fresh air 38 exits in the direction toward the neighboring edge of the housing 1*d*.

As has been explained in regard to the embodiment according to FIGS. 1 through 3, the return air grating 12*d* has also slantedly positioned guide plates. However, these guide plates can be omitted, and this is also possible in the previous embodiments. Since the return air grating 12*d* is positioned between two portions of the fresh air grating 11*d* (FIG. 8), a box 56 is positioned within the super-clean air device in the area above the return air grating 12*d*. The box 56 has the same contour as the grating 12*d* in a view onto the return air grating 12*d*. This box 56 has a slantedly positioned wall 57 extending at a slant downwardly. The width of this wall 57, measured perpendicularly to the plane of the drawing according to FIG. 7, corresponds to the respective width of the return air grating 12*d*. Sidewalls adjoin this wall 57 and extend vertically downwardly and along the longitudinal edges 58, 59 (FIG. 8) of the return air grating 12*d*. In this way, the area above the return air grating 12*d* is separated with regard to flow from the neighboring areas of the fresh air grating 11*d* so that the return air, which enters the housing 1*d* via the return air grating 12*d*, cannot mix with the fresh air 38. At the slantedly positioned wall 57 a portion of or the entire flow of return air is deflected to the pre-filter 46 which protects the high efficiency submicron particulate air filter 7*d* from excessive soiling.

The described super-clean air devices are small modular units which can be used preferably in the pharmaceutical sector, food industry, and the biotechnology sector. The modules represent independent units so that a complicated channel system for supplying the return air is not required. The inner side of the module is smooth so that not only a perfect flow can be ensured but the modules can also be easily cleaned. The temperature control as well as the volume flow control of the module can preferably be realized by a bus systems such as a LON. The modules can be mounted easily at the required locations within the clean rooms.

While specific embodiments of the invention have been shown and described in detail to illustrate the inventive principles, it will be understood that the invention may be embodied otherwise without departing from such principles.

What is claimed is:

1. A super-clean air device for the pharmaceutical sector, foodstuff sector, and biotechnology sector, said super-clean air device comprising:

at least one fan (4, 4*a*, 4*b*, 4*d*) configured to convey fresh air in a conveying direction into a clean room and remove return air from the clean room;

at least one filter (7, 7*a*, 7*b*, 7*d*) arranged downstream of said at least one fan (4, 4*a*, 4*b*, 4*d*) in said conveying direction;

at least one heat exchanger (3, 3*a*, 3*b*, 3*d*) arranged upstream of said fan (4, 4*a*, 4*b*, 4*d*) in said conveying direction;

a common housing (1, 1*a*, 1*b*, 1*d*) comprised of a cover, sidewalls and a bottom together defining an interior space and forming a mounting module, wherein said at least one fan (4, 4*a*, 4*b*, 4*d*), said at least one filter (7, 7*a*, 7*b*, 7*d*), and said at least one heat exchanger (3, 3*a*, 3*b*, 3*d*) are arranged in said interior space and enclosed by said common housing (1, 1*a*, 1*b*, 1*d*).

2. The super-clean air device according to claim 1, comprising at least one partition (8, 8*a*, 8*b*) mounted in said interior space of said common housing (1, 1*a*, 1*b*), wherein said partition (8, 8*a*, 8*b*) separates said at least one heat exchanger (3, 3*a*, 3*b*) from said at least one fan (4, 4*a*, 4*b*) and from said at least one filter (7, 7*a*, 7*b*), wherein said partition (8, 8*a*, 8*b*) has at least one opening (10, 1O*a*) configured to allow return air (34) to flow to said at least one fan (4, 4*a*, 4*b*).

3. The super-clean air device according to claim 2, wherein said housing (1, 1*a*, 1*b*, 1*d*) has a fresh air chamber (5, 5*d*) positioned at an intake side of said at least one fan (4, 4*a*, 4*b*, 4*d*), and wherein said opening (10, 10*a*, 10*d*) opens into said fresh air chamber (5, 5*d*).

4. The super-clean air device according to claim 1, wherein said housing (1, 1*a*, 1*b*, 1*d*) has adjacently positioned housing chambers, wherein said at least one fan (4, 4*a*, 4*b*, 4*d*) is positioned in a first one of said housing chambers and said at least one heat exchanger (3, 3*a*, 3*b*, 3*d*) is positioned in a second one of said housing chambers neighboring said first housing chamber.

5. The super-clean air device according to claim 4, wherein said second housing chamber, in which said at least heat exchanger (3*a*) is positioned, is a central one of said housing chambers.

6. The super-clean air device according to claim 5, wherein a third one of said housing chambers is positioned adjacent to said central housing chamber opposite said first housing chamber, wherein a first one of said at least one fan (4*a*) is positioned in said first housing chamber and a second one of said at least one fan (4*a*) is positioned in said third housing chamber, and wherein a first one of said at least one filters (7*a*) is positioned in said first housing chamber and a second one of said at least one filters (7*a*) is positioned in said third housing chamber.

7. The super-clean air device according to claim 4, wherein said first housing chamber, in which said at least one fan (4*b*) is positioned, is a central one of said housing chambers.

8. The super-clean air device according to claim 7, wherein a third one of said housing chambers is positioned adjacent to said central housing chamber opposite said second housing chamber, wherein a first one of said at least one heat exchangers (3*b*) is positioned in said second housing chamber and a second one of said at least one heat exchangers (3*b*) is positioned in said third housing chamber.

9. The super-clean air device according to claim 4, wherein two of said sidewalls (13, 13*a*, 13*b*, 15, 15*a*, 15*b*) are positioned opposed to one another and wherein said housing chambers (9, 9*a*–9*d*) extend between said two sidewalls.

10. The super-clean air device according to claim 1, wherein two of said sidewalls (13, 13*a*, 13*b*, 15, 15*a*, 15*b*) are positioned opposed to one another and wherein said at least one filter (7, 7*a*, 7*b*, 7*c*, 7*d*) extends between said two sidewalls.

11. The super-clean air device according to claim 1, wherein said housing has an inner side provided with a sound-proofing layer (17, 19, 20, 19*d*, 20*d*).

12. The super-clean air device according to claim 1, wherein said housing (1, 1*a*, 1*b*, 1*d*) has housing chambers, wherein said at least one heat exchanger (3, 3*a*–3*c*) is positioned in a first one of said housing chambers (9, 9*a*–9*c*), wherein said first housing chamber (9, 9*a*–9*c*) has at least one inlet opening (31) for external air (33).

13. The supper clean air device according to claim 1, wherein said at least one heat exchanger (3, 3*a*, 3*b*) is positioned perpendicularly to a flow of return air (34).

14. The supper clean air device according to claim 1, wherein said at least one heat exchanger (3*c*) is positioned angularly to a flow of return air (34).

15. The super-clean air device according to claim 1, wherein said housing has outlet openings for the fresh air (38) and inlet openings for the return air (34), wherein said outlet openings are configured to guide the fresh air away from said inlet openings for the return air.

16. The super-clean air device according to claim 1, wherein said housing (1, 1*a*, 1*b*, 1*d*) is configured to be mounted on a modular ceiling.

17. The super-clean air device according to claim 1, wherein said housing (1, 1*a*, 1*b*, 1*d*) is configured to be mounted by being suspending from a building ceiling.

18. The super-clean air device according to claim 1, wherein said at least one fan (4*d*) and said at least one filter (7*d*) together form a modular unit (47).

19. The super-clean air device according to claim 18, wherein said modular unit (47) comprises at least one sound-proofing layer (19*d*, 20*d*).

20. The super-clean air device according to claim 18, wherein said modular unit (47) comprises a deflecting device (26*d*) arranged downstream of said at least one fan (4*d*) and configured to deflect the fresh air.

21. The super-clean air device according to claim 18, wherein said modular unit (47) is configured to be inserted into said housing (1*d*).

22. The super-clean air device according to claim 1, wherein said housing (1, 1*a*, 1*b*, 1*d*) has inlet openings for the return air (34) and outlet openings for the fresh air (38), wherein said inlet openings and said outlet openings are arranged on the same side of said housing.

23. The super-clean air device according to claim 1, comprising at least one pre-filter (46) arranged in a flow path of the return air upstream of said at least one fan (4*d*).

24. A super-clean air device for the pharmaceutical sector, foodstuff sector, and biotechnology sector, said super-clean air device comprising:

at least one fan (4, 4*a*, 4*b*, 4*d*) configured to convey fresh air in a conveying direction into a clean room and remove return air from the clean room;

at least one filter (7, 7*a*, 7*b*, 7*d*) arranged downstream of said at least one fan (4, 4*a*, 4*b*, 4*d*) in said conveying direction;

at least one heat exchanger (3, 3*a*, 3*b*, 3*d*) arranged upstream of said fan (4, 4*a*, 4*b*, 4*d*) in said conveying direction;

a common housing (1, 1*a*, 1*b*, 1*d*) comprised of a cover, sidewalls and a bottom together defining an interior space and forming a mounting module, wherein said at least one fan (4, 4*a*, 4*b*, 4*d*), said at least one filter (7, 7*a*, 7*b*, 7*d*), and said at least one heat exchanger (3, 3*a*, 3*b*, 3*d*) are arranged in said interior space and enclosed by said common housing (1, 1*a*, 1*b*, 1*d*);

wherein said interior space of said housing (1*d*) has housing chambers, wherein said at least one heat exchanger (3*d*) is positioned in a first one of said housing chambers (9*d*), wherein said housing (1*d*) has an inlet opening (32*d*) for external air (33), wherein said inlet opening (32*d*) and said first housing chamber (9*d*) are positioned on opposite sides of said at least one fan (4*d*).

25. A super-clean air device for the pharmaceutical sector, foodstuff sector, and biotechnology sector, said super-clean air device comprising:

at least one fan (4, 4*a*, 4*b*, 4*d*) configured to convey fresh air in a conveying direction into a clean room and remove return air from the clean room;

at least one filter (7, 7*a*, 7*b*, 7*d*) arranged downstream of said at least one fan (4, 4*a*, 4*b*, 4*d*) in said conveying direction;

at least one heat exchanger (3, 3*a*, 3*b*, 3*d*) arranged upstream of said fan (4, 4*a*, 4*b*, 4*d*) in said conveying direction;

a common housing (1, 1*a*, 1*b*, 1*d*) comprised of a cover, sidewalls and a bottom together defining an interior space and forming a mounting module, wherein said at least one fan (4, 4*a*, 4*b*, 4*d*), said at least one filter (7, 7*a*, 7*b*, 7*d*), and said at least one heat exchanger (3, 3*a*, 3*b*, 3*d*) are arranged in said interior space and enclosed by said common housing (1, 1*a*, 1*b*, 1*d*);

wherein said housing (1, 1*a*, 1*b*, 1*d*) has inlet openings for the return air (34) and outlet openings for the fresh air (38), wherein said inlet openings and said outlet openings are arranged on the same side of said housing;

wherein said housing comprises a fresh air grating (11, 11*d*) and a return air grating (12*d*), wherein said outlet openings are provided in said fresh air grating (11, 11*d*) and wherein said inlet openings are provided in said return air grating (12*d*), and wherein said fresh air grating (11, 11*d*) surrounds at least partially said return air grating (12*d*).

* * * * *